United States Patent [19]

Benoit

[11] Patent Number: 4,817,212

[45] Date of Patent: Apr. 4, 1989

[54] NIGHTTIME WATERSPORTS ILLUMINATOR

[76] Inventor: Edward J. Benoit, 1030 Grand Ave., San Diego, Calif. 92109

[21] Appl. No.: 73,566

[22] Filed: Jul. 15, 1987

[51] Int. Cl.[4] ..... A42B 1/24

[52] U.S. Cl. ..... 2/209.2; 2/68; 2/199; 362/106

[58] Field of Search ..... 2/209.2, 68, 422, 199; 362/105, 106

[56] References Cited

U.S. PATENT DOCUMENTS

| | | | |
|---|---|---|---|
| 2,320,222 | 5/1943 | Crupi | 362/106 |
| 3,963,917 | 6/1976 | Romano | 362/106 X |
| 4,521,831 | 6/1985 | Thayer | 362/106 X |
| 4,638,410 | 1/1987 | Barker | 362/105 |

*Primary Examiner*—Peter Nerbun
*Attorney, Agent, or Firm*—Frank D. Gilliam

[57] ABSTRACT

A new type of watersports equipment that allows sports participants the opportunity to engage in their particular watersport at night. The sports participant wears a headpiece made of rubber, plastic or some other suitable material to which may be affixed any number of suitably sized waterproof lights. The lights can either be attached directly and permanently to the headpiece or can be housed in an enclosure with the lens or lenses showing through.

The headpiece can be firmly attached to the wearer's head by different combinations of straps and fasteners. If necessary the invention can have an auxiliary power source carried by the wearer. The nighttime watersports illuminator can be used in a number of different watersports. It can increase the duration of the wearer's available time of participation in his or her particular sport by allowing the activity to be conducted after dark.

7 Claims, 1 Drawing Sheet

NIGHTTIME WATERSPORTS ILLUMINATOR

BACKGROUND

1. Field of Invention

The invention relates to outdoor watersports, particularly those that require hands remaining free for the purpose of paddling, swimming, etc. and require visual facility for judging and gauging distances and heights.

2. Discussion of Prior Art

Heretofore, outdoor watersports have been considered a daytime activity because they require the participant to be able to visually monitor his or her field of activity, namely the surrounding water. While some ocean water sports, such as swimming, can be conducted in the dark, there are others that require definite visual facility for the participation in the sport, such as board surfing or body surfing. A search of patents in this field revealed no prior art directly germane to this invention. While a few patents have been filed for sports headwear that provide aural communication to the sportsman, the majority of patented sports headwear is of a protective nature such as football, boxing and motorcycle helmets. No water sports headwear providing illumination was found. Most outdoor watersports have been limited to daylight hours, as the need for light is essential in the conducting of the sport.

OBJECTS AND ADVANTAGES

Accordingly, the most obvious objects and advantages of my invention is that the sportsman will be able to conduct a particular watersport any time of the day or night. A person who works during the daylight hours will be able to enjoy outdoor water recreation in the evening or at night. Very often, in sports such as board surfing or body surfing, participation in the sport is directly dependent on the ocean conditions at the time. Conditions such as the size of the waves or the direction of the wind, etc., are directly related to the degree of enjoyment one may derive from a given sports activity. Presently, if ocean conditions are favorable after dark, the sportsman is not able to take advantage of it. One may also want to avoid crowded beaches. My invention allows the ocean sportsman to engage in watersports activities in such circumstances.

Further objects and advantages of my invention will become apparent from a consideration of the drawings and ensuing description of it.

DRAWING FIGURES

DRAWING REFERENCE NUMERALS

Figure 1:
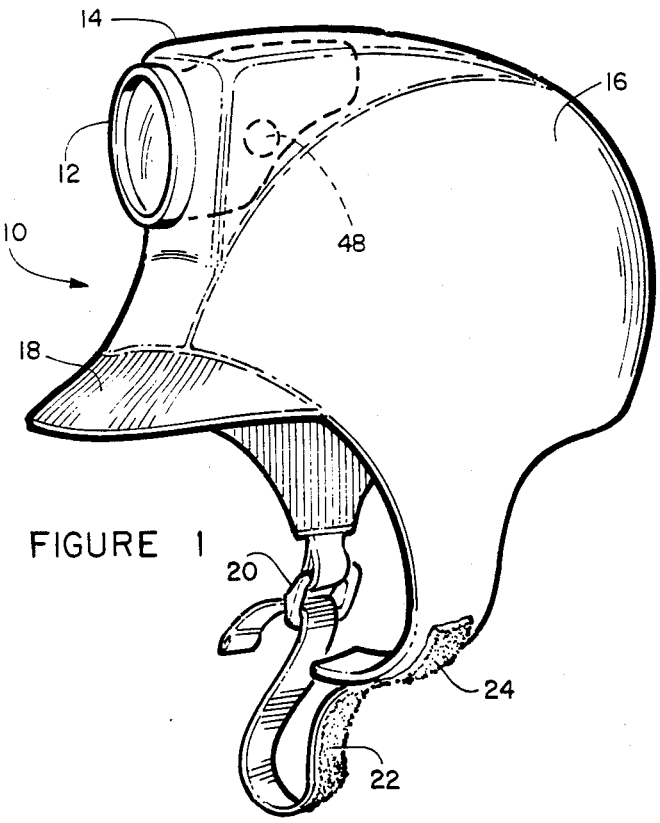
FIG. 1 shows a side view of the invention.

10 side view of preferred embodiment of the invention
12 waterproof light
14 light enclosure
16 neoprene rubber hat
18 hard rubber brim
20 plastic buckle

22 velcro* strap
24 velcro* fastener
30 auxiliary power source cord
32 auxiliary power source (waterproof battery pac)
34 auxiliary power source clip
**36*a&b*** waterproof lights
**38*a&b* switches for 36*a&b***
40 hard plastic bicycle type helmet
42 chin strap
44 metal loop buckle
46 chin pad

NIGHTTIME WATERSPORTS ILLUMINATOR -- DESCRIPTION

Figure 2:
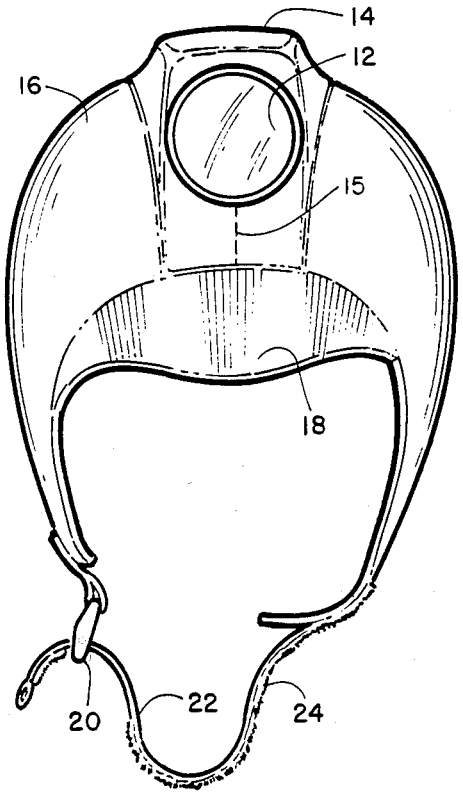
FIG. 2 shows the front view of the invention.

FIGS. 1 and 2 show a nighttime watersports illuminator according to the preferred embodiment of the invention. A neoprene rubber hat 16 fits closely on the wearer's head. The light enclosure 14 securely holds a waterproof light 12 with the lens of the light showing through the light enclosure 14. The waterproof light 12 is removable and is inserted into the light enclosure 14 from the inside of the neoprene rubber hat 16. A hard rubber brim 18 is fastened to the front of the neoprene rubber hat 16. A velcro* strap 12 loops through a plastic buckle 20. The velcro* strap 22 fastens on to a velcro* fastener 24.

Figure 3:
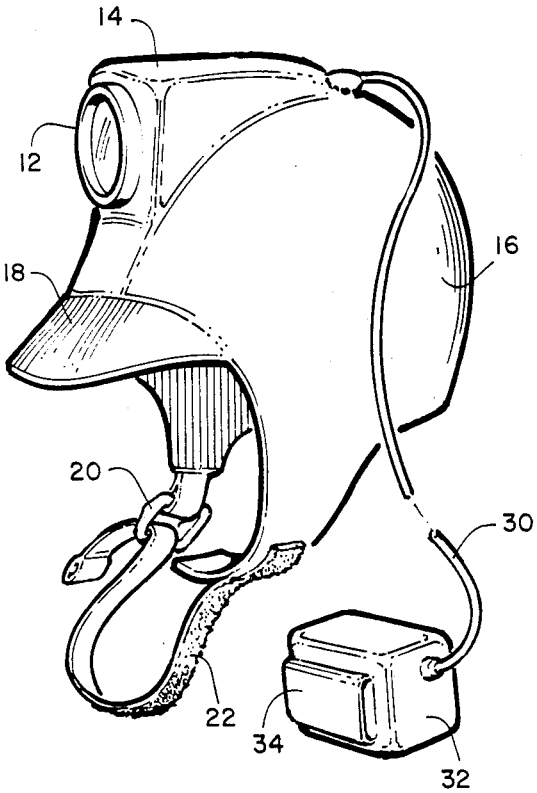
FIG. 3 shows the side view of the invention with an optional auxiliary power source.

FIG. 3 shows another embodiment of the invention. The physical structure of this embodiment is basically the same as in FIG. 1 and 2. The neoprene rubber hat 16 holds waterproof light 12 inside the light enclosure 14. The same velcro* strap 22, the plastic buckle 20, and the velcro* fastener 24 are all present.

However this embodiment is somewhat different in that it has an auxiliary power source 32 connected to the waterproof light 12 by the auxiliary power source cord 30. An auxiliary power source clip 34 is shown on the auxiliary power source 32.

Figure 4:
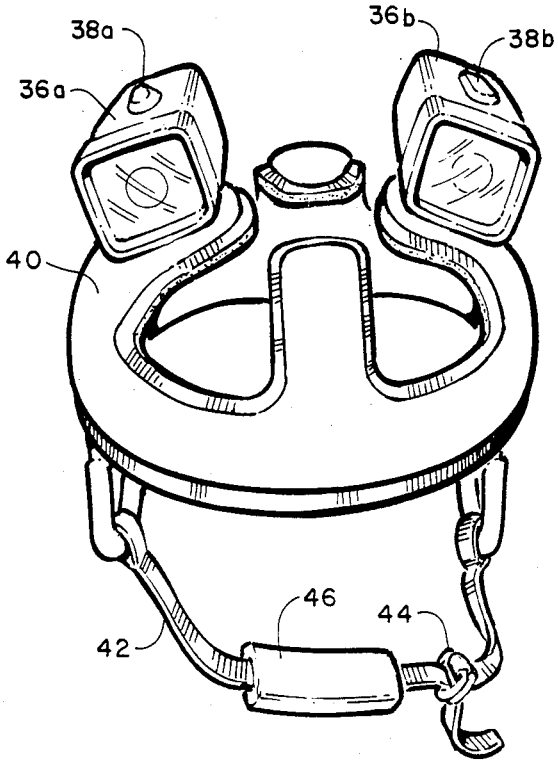
FIG. 4 shows a front view of a different embodiment of the invention. This embodiment employs a different design, different materials, and more than one light source.

FIG. 4 exhibits a completely different embodiment of the invention than what is shown in FIGS. 1, 2 & 3. This embodiment employs a hard plastic bicycle type helmet 40 on which are mounted two waterproof lights **36*a&b*. The waterproof lights 36*a&b* are attached to the helmet 40 with screws and epoxy. The waterproof lights 36*a&b* are not removable and require no light enclosure as shown in FIGS. 1, 2 & 3. The waterproof lights 36*a&b* are activated by switches 38*a&b*. The chin strap 42 loops through the metal loop buckle 44. There is a chin pad 46 on the chin strap 42**.

NIGHTTIME WATERSPORTS ILLUMINATOR -- OPERATION

The nighttime watersports illuminators shown in FIGS. 1, 2, 3 & 4 are designed to afford the ocean sportsman the liberty to increase the amount of time he or she may spend participating in his or her particular sport. The nighttime watersports illuminators shown in FIGS. 1&2 consist of a neoprene rubber hat 16 with a hard rubber brim 18 and a velcro* strap 22 and fastener 24 looped through a plastic buckle 20. A waterproof light 12, which is powered by dry cell batteries, is inserted into the light enclosure 14 through a slit 15 in the upper inside portion of the neoprene rubber hat 16. The nighttime watersports illuminator 10 is then put onto the wearer's head. The velcro* strap 22 is then pulled through the plastic buckle 20 and fastened at the velcro* fastener 24. The waterproof light 12 is then activated by an unexposed switch 48 on top of the waterproof light 12 inside the light enclosure 14. The switch is easily operable from the outside of the light enclosure 14. The nighttime watersports illuminator is designed particularly for but not limited to ocean water sports. The frequent rough conditions of the ocean necessary to conduct some particular sports, such as board surfing or body surfing, require the velcro* strap 22 to be tightly drawn to the wearer's chin. This prevents loss of the invention in the water. The hard rubber brim 18 is utilized to deflect the on coming water from the face of the wearer and to keep the illumination from the waterproof light 12 from reflecting into the wearer's eyes. The wearer is then at liberty to conduct his particular watersport after dark thereby increasing the duration of his or her enjoyment.

FIG. 3 shows the same embodiment as was described in the previous paragraph. Its function and operation are identical to those described for FIGS. 1 & 2. However, FIG. 3 shows an auxiliary power source 32 which can be utilized in the event a more powerful light is employed or for extended continual use of the invention by the wearer. The auxiliary power source 32 is connected to the waterproof light 12 by the auxiliary power source cord 30. The auxiliary power source 32 is secured to the wearer by the use of the auxiliary power source clip 34.

FIG. 4 shows a completely different embodiment of the invention from those shown in FIGS. 1, 2 & 3. In this embodiment, the neoprene rubber hat 16 has been replaced by a hard plastic bicycle type helmet 40. The helmet 40 is open on the top to avoid holding water. This embodiment employs the use of more than one waterproof light. In FIG. 4, two waterproof lights **36*a* & 36*b* are shown. This embodiment is put on the wearer's head and is held securely by chin strap 42 and the metal loop buckle 44. The chin pad 46 is included to provide comfort for the wearer. The waterproof lights 36*a* & 36*b* are activated by the switches 38*a*&38*b*. An auxiliary power source 32 can also be utilized on the embodiment shown in FIG. 4**.

With the nighttime watersports illuminator properly worn by the wearer as previously described and waterproof lights properly activated, the sportsman is at liberty to conduct his particular sport after dark.

The nighttime watersports illuminator makes it possible to engage in outdoor watersports in the dark. This would allow the sportsman to utilize more available time for the watersport of his choice especially if he or she is otherwise engaged during the daylight hours or if the water and weather conditions are more favorable after dark.

While my above descriptions contain many specifications, these should not be construed as limitations on the scope of the invention but rather as a exemplification of two embodiments thereof. All types of embodiments could contain any number of lights. Different embodiments could be made of other materials or have alternate means of activation. The lenses of the lights could be enlarged or focused differently. There are many possible variations.

I have not gone to great lengths in my descriptions or drawings to detail the parts and construction of some pieces of the invention such as the waterproof lights or the auxiliary power source. That is because these items are readily available in most locations. I used commercial light etc. in my prototypes. There are a wide variety of lights available and any of a number of these could be used for the nighttime watersports illuminator with just minor design adjustments.

I find straps with buckles to be the most effective means of securing the invention to the wearer's head. Snaps or ties sometimes prove unreliable but their use should not be altogether ruled out.

While the nighttime watersports illuminator would be very effective in conducting some watersports after dark, I would like to state that there are some sports where the use of the nighttime watersports illuminator would not be recommended. For example, not many would attempt to go sailboating or water skiing in the dark with the aid of my invention. The different particular uses of the nighttime watersports illuminator would be up to the discretion of each individual wearer.

*Velcro is a registered trade mark of Velcro U.S.A. Inc., Manchester N.H. 03108.

I claim:

1. Head gear for water sports comprising:

a hood constructed of stretchable material for enclosing in a water tight manner the head of a wearer, said hood having a chamber with a bottom surface for containing an illumination means, said chamber having an opening through the front upper surface thereof and a slit through the bottom surface for providing access to said opening from the interior of said chamber;

a waterproof illumination means with a front lens for light illumination therethrough and an "on" and "off" switch for controlling the illumination of said light, said light being insertable from the interior of said hood through said slit into said chamber with said lens extending through said opening in a water tight sealed relationship therewith and said switch being operable between said "on" and "off" positions through the stretchable material of said hood from the exterior of said hood;

a rigid rim is attached to the front of said hood at a location between said opening and the eyes of the wearer whereby reflected illumination from said light is not transmitted to the eyes of the wearer of the hood; and a single releasable length adjustable strap being attached to said hood for selectively securing the hood under the chin of the wearer.

2. The invention as defined in claim 1 wherein said water proof light has a self contained power supply.

3. The invention as defined in claim 1 wherein said hood is formed of neoprene rubber.

4. The invention as defined in claim 1 wherein said single releasable length adjustable strap comprises both hook and eye fastener material.

5. The invention as defined in claim 1 wherein said light includes an auxiliary power supply positioned remote from said hood.

6. The invention as defined in claim 1 wherein said rigid rim is in the form of a protruding visor.

7. The invention as defined in claim 1 wherein said rigid rim is constructed of hard rubber.

* * * * *